US010938114B2

(12) United States Patent
Kim

(10) Patent No.: US 10,938,114 B2
(45) Date of Patent: Mar. 2, 2021

(54) ARRAY ANTENNA

(71) Applicant: ATCODI CO., LTD, Seoul (KR)

(72) Inventor: Jeong Pyo Kim, Suwon-si (KR)

(73) Assignee: ATCODI CO., LTD, Seoul (KR)

( * ) Notice: Subject to any disclaimer, the term of this patent is extended or adjusted under 35 U.S.C. 154(b) by 0 days.

(21) Appl. No.: 16/966,589

(22) PCT Filed: Mar. 8, 2018

(86) PCT No.: PCT/KR2018/002788
§ 371 (c)(1),
(2) Date: Jul. 31, 2020

(87) PCT Pub. No.: WO2019/156281
PCT Pub. Date: Aug. 15, 2019

(65) Prior Publication Data

US 2020/0366003 A1 Nov. 19, 2020

(30) Foreign Application Priority Data

Feb. 12, 2018 (KR) ..... 10-2018-0016837

(51) Int. Cl.
*H01Q 21/28* (2006.01)
*H01Q 13/20* (2006.01)
(Continued)

(52) U.S. Cl.
CPC ..... *H01Q 13/206* (2013.01); *H01Q 1/46* (2013.01); *H01Q 21/065* (2013.01); *H01Q 21/28* (2013.01)

(58) Field of Classification Search
CPC ..... H01Q 1/46; H01Q 13/206; H01Q 21/065; H01Q 21/28
See application file for complete search history.

(56) References Cited

U.S. PATENT DOCUMENTS 3,987,455 A * 10/1976 Olyphant, Jr. ..... H01Q 13/206 343/829
4,180,817 A * 12/1979 Sanford ..... H01Q 13/206 342/375

(Continued)

FOREIGN PATENT DOCUMENTS

JP 2013-543283 A 11/2013
KR 10-2010-0074053 A 7/2010

(Continued)

OTHER PUBLICATIONS

Search Report, dated Sep. 28, 2018, for International Application No. PCT/KR2018/002788.

(Continued)

*Primary Examiner* — Ab Salam Alkassim, Jr.
(74) *Attorney, Agent, or Firm* — LRK Patent Law Firm

(57) ABSTRACT

An array antenna includes: a first radiation body of which one end is connected to a first power supply line; a second radiation body of which one end is connected through a second power supply line connected to the other end of the first radiation body; a third radiation body of which one end is connected through a third power supply line connected to the other end of the second radiation body; and a fourth radiation body of which one end is connected through a fourth power supply line connected to the other end of the third radiation body, wherein the first and second radiation bodies are formed to be symmetrical with the third and fourth radiation bodies on the basis of the third power supply line.

5 Claims, 9 Drawing Sheets

(51) Int. Cl.
*H01Q 1/46* (2006.01)
*H01Q 21/06* (2006.01)

(56) References Cited

U.S. PATENT DOCUMENTS 4,521,781 A * 6/1985 Campi ..... H01Q 3/443 333/246
5,923,290 A * 7/1999 Mikami ..... H01Q 3/22 342/374
6,147,658 A * 11/2000 Higashi ..... H01Q 3/12 333/167
9,685,714 B2 * 6/2017 Milyakh ..... H01Q 21/065
2008/0198076 A1 * 8/2008 Andersson ..... H01Q 1/2266 343/702
2008/0258976 A1 * 10/2008 Schillmeier ..... G06K 7/10336 343/700 MS
2010/0171666 A1 * 7/2010 Mizutani ..... H01Q 21/0037 343/700 MS
2011/0128201 A1 * 6/2011 Ju ..... H01Q 15/244 343/756
2013/0222204 A1 * 8/2013 Binzer ..... H01Q 13/206 343/853
2014/0078006 A1 * 3/2014 Park ..... H01Q 5/335 343/700 MS
2015/0054712 A1 * 2/2015 Milyakh ..... H01Q 21/0075 343/893
2015/0253419 A1 * 9/2015 Alland ..... G01S 13/4463 342/385
2015/0255870 A1 * 9/2015 Okunaga ..... H01Q 21/065 343/700 MS
2017/0293028 A1 * 10/2017 Trummer ..... H01Q 3/26
2017/0373402 A1 * 12/2017 Chung ..... H01Q 1/38
2018/0115084 A1 * 4/2018 Tsuchiya ..... H01Q 21/0075
2019/0067833 A1 * 2/2019 Minami ..... H01Q 13/08
2020/0052390 A1 * 2/2020 Ahmadloo ..... H01Q 1/3233
2020/0076092 A1 * 3/2020 Chiang ..... H01Q 19/005

FOREIGN PATENT DOCUMENTS

KR 10-2012-0035459 A 4/2012
KR 10-1470581 B1 12/2014
KR 10-2017-0028598 A 3/2017
KR 10-2017-0051046 A 5/2017

OTHER PUBLICATIONS

Written Opinion, dated Sep. 28, 2018, for International Application No. PCT/KR2018/002788.

* cited by examiner

200

200

ARRAY ANTENNA

CROSS-REFERENCE TO RELATED APPLICATIONS

The present application is a U.S. National Phase entry from International Application No. PCT/KR2018/002788, filed Mar. 8, 2018, which claims priority to Korean Patent Application No. 10-2018-0016837, filed Feb. 12, 2018, the disclosure of which is incorporated by reference herein in its entirety.

BACKGROUND

1. Technical Field

The present invention relates to an array antenna. More specifically, the present invention relates to an array antenna which can improve side lobe characteristics and minimize interference between radiators.

2. Description of Related Art

Introduction of 4G mobile communication technology, and 5G mobile communication technology, which will be commercialized in the future, require a multi-input multi-output (MIMO) antenna including a plurality of input terminals and output terminals, and the MIMO antenna like this generally includes a plurality of array antennas.

On the other hand, since the MIMO antenna includes a plurality of radiators, the overall size of the antenna inevitably increases, and this has a problem in that it is against the current trend in the field of antenna becoming smaller and slimmer.

In addition, since the MIMO antenna includes a plurality of radiators, there is a problem in that performance of the MIMO antenna decreases due to the interference phenomenon generated between the beam patterns emitted by each radiator.

Therefore, it is required to provide a new and advanced technique capable of miniaturizing and slimming an antenna, reducing the interference phenomenon, and improving the side lobe characteristics in a MIMO antenna including a plurality of radiators. The present invention relates to this.

DISCLOSURE OF INVENTION

Technical Problem

Therefore, the present invention has been made in view of the above problems, and it is an object of the present invention to provide an array antenna, i.e., the basic structure of a MIMO antenna, which is miniaturized and slimmed overall.

Another object of the present invention is to provide an array antenna which can reduce the interference phenomenon in a MIMO antenna including a plurality of radiators.

Still another object of the present invention is to provide an array antenna which can improve side lobe characteristics in a MIMO antenna including a plurality of radiators.

The problems of the present invention are not limited to the problems mentioned above, and other problems not mentioned will be clearly understood by those skilled in the art from the following description.

Technical Solution

To accomplish the above objects, according to one aspect of the present invention, there is provided an array antenna comprising: a first radiator, one end of which is connected to a first feeding line; a second radiator, one end of which is connected through a second feeding line connected to the other end of the first radiator; a third radiator, one end of which is connected through a third feeding line connected to the other end of the second radiator; and a fourth radiator, one end of which is connected through a fourth feeding line connected to the other end of the third radiator, wherein the first and second radiators and the third and fourth radiators are symmetric with respect to the third feeding line.

According to an embodiment, the first feeding line, the second feeding line, the third feeding line, and the fourth feeding line may be arranged in the same direction, and the width of the second radiator may be larger than the width of the first radiator on the basis of the third feeding line, and the width of the third radiator may be larger than the width of the fourth radiator on the basis of the third feeding line.

According to an embodiment, the widths may be measured on the basis of a direction perpendicular to the arrangement direction of the first feeding line, the second feeding line, the third feeding line, and the fourth feeding line.

According to an embodiment, the first radiator, the second radiator, the third radiator, and the fourth radiator may be in a shape of any one among a circular shape or a regular N-polygonal shape (N is a multiple of 4).

According to an embodiment, the first radiator may further include a first slot symmetric up, down, left and right, and the fourth radiator may further include a fourth slot of a shape the same as that of the first slot.

According to an embodiment, the first radiator and the fourth radiator may have a regular N-polygonal shape (N is a multiple of 4), and all corners may be partially dug in the same shape.

According to an embodiment, the first radiator, the second radiator, the third radiator, and the fourth radiator may have an M-polygonal shape (M is a positive integer) symmetric in the diagonal direction.

According to an embodiment, the second radiator may be shared with a second array antenna different from the array antenna, and the third radiator may be shared with a third array antenna different from the array antenna.

Advantageous Effects

According to the present invention as described above, since it is possible to implement an array antenna including a plurality of radiators having different sizes and symmetric shapes on the basis of the center of the antenna, there is an effect of miniaturizing and slimming a MIMO antenna including the array antenna.

In addition, since a slot for improving the characteristics of the beam pattern is formed in some of the plurality of radiators, there is an effect of miniaturizing and slimming the MIMO antenna.

In addition, since the array antenna is arranged to include a plurality of radiators having different sizes and symmetric shapes on the basis of the center of the antenna, and a MIMO antenna can be implemented by intersecting the array antenna with other array antennas in the vertical direction, there is an effect of reducing the interference phenomenon as the array antenna operates in an orthogonal mode.

In addition, since it is possible to concentrate radiation power in the main radiation direction and distribute radiation power directed in other directions as input signals inputted into a plurality of radiators are supplied to have varied magnitude and the same phase, there is an effect of improving the side lobe characteristics.

The effects of the present invention are not limited to the effects mentioned above, and other effects not mentioned will be clearly understood by those skilled in the art from the following description.

Figure 1:
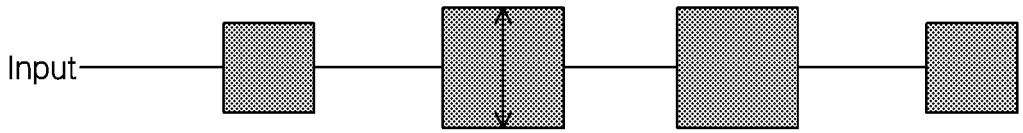
FIG. 1 is a plan view showing an array antenna according to a first embodiment of the present invention.

Meanwhile, reference numerals used in the drawings are as follows.

100: Array antenna
10: First radiator
10: Second radiator
10: Third radiator
10: Fourth radiator
200: MIMO antenna

BEST MODE FOR CARRYING OUT THE INVENTION

Hereafter, the preferred embodiments of the present invention will be described in detail with reference to the accompanying drawings. Advantages and features of the present invention and methods of achieving them will be apparent with reference to the embodiments described below in detail together with the accompanying drawings. However, the present invention is not limited to the embodiments disclosed below, and may be implemented in various forms different from each other, and these embodiments are provided only to make the disclosure of the present invention complete and to completely inform the scope of the present invention to those skilled in the art, and the present invention is defined only by the scope of the claims. Throughout the specification, like reference numerals refer to like components.

Unless otherwise defined, all terms (including technical and scientific terms) used in the present specification may be used in a meaning that can be commonly understood by those skilled in the art. In addition, the terms defined in a generally used dictionary are not ideally or excessively interpreted unless explicitly and specially defined. The terms used in the present specification are for describing the embodiments and not intended to limit the present invention. In the present specification, singular forms also include plural forms unless otherwise specified in the phrase.

"Comprises" and/or "comprising" used in the present specification does not exclude presence or addition of one or more other components, steps, operations and/or elements than the mentioned components, steps, operations and/or elements.

FIG. 1 is a plan view showing an array antenna 100 according to a first embodiment of the present invention.

The array antenna 100 according to a first embodiment of the present invention includes a first radiator 10, one end of which is connected to a first feeding line 12, a second radiator 20, one end of which is connected through a second feeding line 22 connected to the other end of the first radiator 10, a third radiator 30, one end of which is connected through a third feeding line 32 connected to the other end of the second radiator 20, and a fourth radiator 40, one end of which is connected through a fourth feeding line 42 connected to the other end of the third radiator 30.

However, this is only an embodiment, and the array antenna 100 according to a first embodiment of the present invention may include a larger number of radiators and feeding lines connecting these radiators, and the radiators may be a concept including both pattern-shape radiators or patch-shape radiators.

Referring to FIG. 1, it can be confirmed that the first radiator 10, the second radiator 20, the third radiator 30, and the fourth radiator 40 are shown in order from the left radiator, and the first feeding line 12, which is an input terminal, is connected to one end of the first radiator 10. This may be considered that an initial input signal is transferred to the first radiator 10 through the first feeding line 12, and then sequentially transferred to the second radiator 20 through the second feeding line 22, to the third radiator 30 through the third feeding line 32, and to the fourth radiator 40 through the fourth feeding line 42.

Meanwhile, although the input signal is sequentially transferred, the magnitude of the input signal transferred to the radiators through each of the feeding lines is different, and the phases are the same. This is for improving the side lobe characteristics, and it is possible to concentrate the radiation power in the main radiation direction and distribute the radiation power directed in the other directions.

Referring to FIG. 1, it can be confirmed that the first radiator 10 and the second radiator 20 are symmetric to the third radiator 30 and the fourth radiator 40 with respect to the third feeding line 32 that can be regarded as the center of the array antenna 100 according to a first embodiment of the present invention, and here, symmetry is a concept including the size, as well as the shape. That is, the first radiator 10 and the fourth radiator 40, and the second radiator 20 and the third radiator 30 may be regarded as the same radiators, of which only the order of arrangement is different.

Meanwhile, although the first radiator 10, the second radiator 20, the third radiator 30, and the fourth radiator 40 are shown to have a square shape in FIG. 1, this is only an example, and the first radiator 10, the second radiator 20, the third radiator 30, and the fourth radiator 40 may have a shape of any one among a circular shape and a regular N-polygonal shape (N is a multiple of 4). For example, all of the first radiator 10, the second radiator 20, the third radiator 30, and the fourth radiator 40 may be a regular octagonal shape or a circular shape. In addition, since the first radiator 10 and the fourth radiator 40, and the second radiator 20 and the third radiator 30 may be regarded as the same radiators, of which only the order of arrangement is different as described above, it is possible to implement the first radiator 10 and the fourth radiator 40 in a regular N-polygonal shape and the second radiator 20 and the third radiator 30 in a circular shape, or the first radiator 10 and the fourth radiator 40 in a circular shape and the second radiator 20 and the third radiator 30 in a regular N-polygonal shape. That is, it does not mean that the shapes of the first radiator 10, the second radiator 20, the third radiator 30, and the fourth radiator 40 should be the same, and if the shapes of the first radiator 10 and the fourth radiator 40 are the same as the shapes of the second radiator 20 and the third radiator 30, the radiators may be implemented by mixing circular shapes and regular N-polygonal shapes, and even when the radiators are implemented only in a regular N-polygonal shape, the first radiator 10 and the fourth radiator 40 may be implemented in a square shape, and the second radiator 20 and the third radiator 30 may be implemented in a regular octagonal shape. However, it will be described below focusing on the first radiator 10, the second radiator 20, the third radiator 30, and the fourth radiator 40 of a square shape as shown in FIG. 1, and in this case, there is an advantage in that the intersection mode of the MIMO antenna 200 including the array antenna 100 can be implemented.

The first feeding line 12, the second feeding line 22, the third feeding line 32, and the fourth feeding line 42 connecting the radiators are arranged in the same direction, and although there may be a slight difference, the same direction means that the directions basically arranged to face a direction are the same, and referring to FIG. 1, it can be confirmed that the feeding lines are arranged in a straight line with interposition of a radiator therebetween. That is, since the directions are the same, the angle formed by each of the first feeding line 12, the second feeding line 22, the third feeding line 32, and the fourth feeding line 42 is $180°\pm\alpha$ (it is general that a is a value that does not exceed 10° with a slight difference).

Meanwhile, on the basis of the third feeding line 32, which may be regarded as the center of the array antenna 100 according to a first embodiment of the present invention, the width of the second radiator 20 is larger than the width of the first radiator 10, and the width of the third radiator 30 is larger than the width of the fourth radiator 40. That is, the width of the radiators decreases toward the first feeding line 12, which is the input terminal, or toward the opposite direction from the center.

In the case of FIG. 1, since the first radiator 10, the second radiator 20, the third radiator 30, and the fourth radiator 40 are square shapes, it does not make a difference although the width is measured in the horizontal or vertical direction. However, the "width" herein means a width measured on the basis of a direction that is perpendicular to the arrangement direction of the first feeding line 12, the second feeding line 22, the third feeding line 32, and the fourth feeding line 42, and the arrow displayed (in the vertical direction) inside the second radiator 20 of FIG. 1 as an example may be regarded as the width.

Meanwhile, although the first radiator 10, the second radiator 20, the third radiator 30, and the fourth radiator 40, i.e., four radiators, are included in the case of FIG. 1, when a different number of radiators are included, the width not always decreases as the distance from the center increases. Since the radiation power of individual radiators or the magnitude of an input signal fed to the radiators decreases and then increases again, and decreases again thereafter in some cases as the distance from the center increases depending on the array antenna theory and performance goals, in this case, the width may decrease and then increases again, and decrease again thereafter as the distance from the center increases like the radiation power or the magnitude of an input signal. That is, the width of the radiator is specifically in accordance with Equation 1 shown below, and this is the same in the case of FIG. 1.

$$G = 0.016\left(\frac{W}{\lambda_0}\right)^{1.757} \quad \text{[Equation 1]}$$

Here, G is a conductance value of the equivalent circuit of the radiator and has a proportional relation with the radiation power, $\lambda_0$ is the wavelength in a free space, and W is the width of the radiator.

Figure 2:
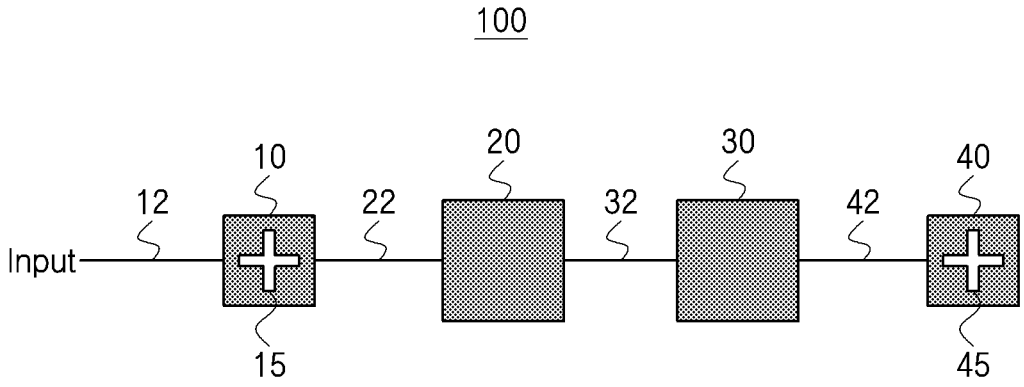
FIG. 2 is a plan view showing an array antenna according to a second embodiment of the present invention.

FIG. 2 is a plan view showing an array antenna 100 according to a second embodiment of the present invention.

All the matters described about the array antenna 100 according to a first embodiment are equally applied to the array antenna 100 according to a second embodiment, and it will be described below focusing on the difference.

Referring to FIG. 2, it can be confirmed that a slot of a cross shape symmetric up, down, left and right is included at the center of the first radiator 10 and the fourth radiator 40, and this is referred to as a first embodiment of the slot, and here, the slot included in the first radiator 10 is a first slot 15, the slot included in the fourth radiator 40 is a fourth slot 45, and the first slot 15 and the fourth slot 45 have the same shape. Hereinafter, the slots will be described in more detail.

Figure 3:
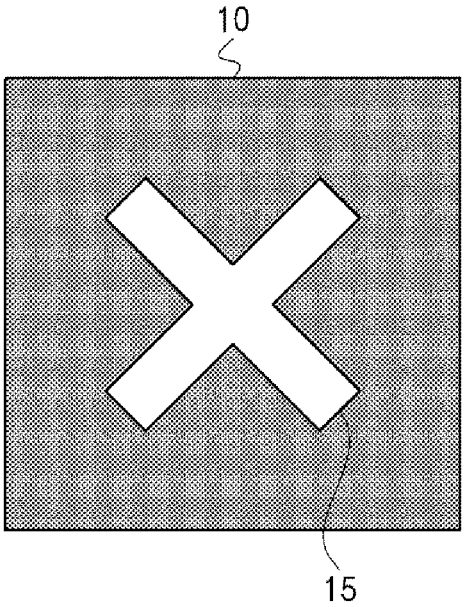
FIG. 3 is a view showing a second embodiment of a first slot included in a first radiator.

FIG. 3 is a view showing a second embodiment of the first slot 15 included in the first radiator 10, and since the fourth slot 45 has a shape the same as that of the first slot 15, it is not described separately.

The second embodiment of the first slot 15 may be regarded as a rotation of the first slot 15 shown in FIG. 2 by 45° in the clockwise or counterclockwise direction, and this may also be regarded as a shape symmetric up, down, left and right.

Figure 4:
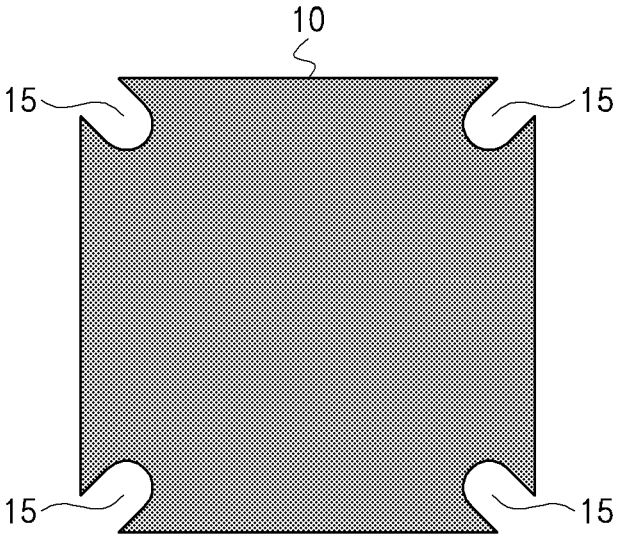
FIG. 4 is a view showing a third embodiment of a first slot included in a first radiator.

FIG. 4 is a view showing a third embodiment of the first slot 15 included in the first radiator 10, and since the fourth slot 45 has a shape the same as that of the first slot 15, it is not described separately.

Referring to FIG. 4, it can be confirmed that all corners of the first radiator 10 of a square shape are partially dug in the same shape, and this may also be regarded as a shape symmetric up, down, left and right, and the first radiator 15 according to a third embodiment may be implemented when the first radiator 10 is a regular N-polygonal shape (N is a multiple of 4) as shown in FIG. 4.

Figure 5:
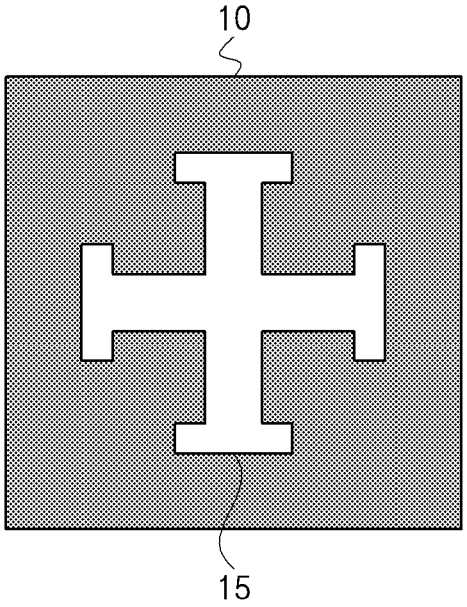
FIG. 5 is a view showing a fourth embodiment of a first slot included in a first radiator.

FIG. 5 is a view showing a fourth embodiment of the first slot 15 included in the first radiator 10, and since the fourth slot 45 has a shape the same as that of the first slot 15, it is not described separately.

Referring to FIG. 5, it is confirmed that the first slot 15 according to a fourth embodiment has a "|" shape added at the horizontal end and a "-" shape added at the vertical end of the cross-shaped first slot 15 according to the first embodiment shown in FIG. 2, and this may also be regarded as a shape symmetric up, down, left and right.

Figure 6:
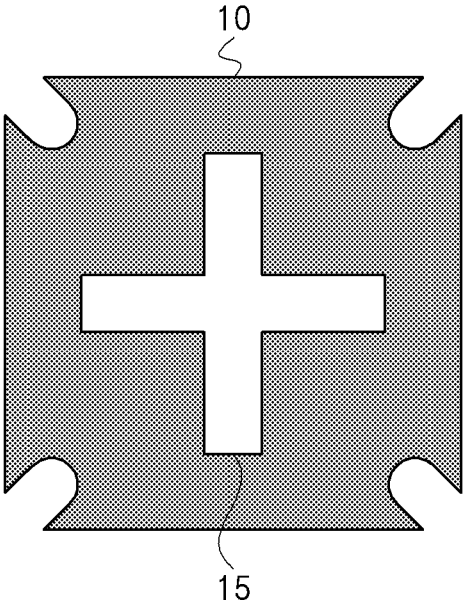
FIG. 6 is a view showing a fifth embodiment of a first slot included in a first radiator.

FIG. 6 is a view showing a fifth embodiment of the first slot 15 included in the first radiator 10, and since the fourth slot 45 has a shape the same as that of the first slot 15, it is not described separately.

Referring to FIG. 6, as it can be confirmed that the first slot 15 according to a fifth embodiment includes both the first slot 15 according to a first embodiment and the first slot 15 according to a third embodiment, this may also be regarded as a shape symmetric up, down, left and right.

Figure 7:
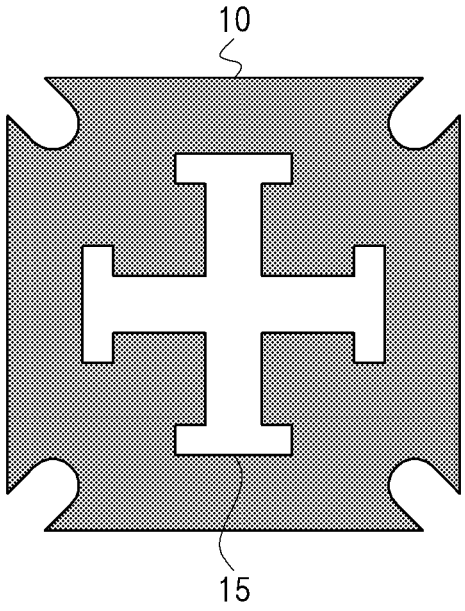
FIG. 7 is a view showing a sixth embodiment of a first slot included in a first radiator.

FIG. 7 is a view showing a sixth embodiment of the first slot 15 included in the first radiator 10, and since the fourth slot 45 has a shape the same as that of the first slot 15, it is not described separately Referring to FIG. 7, as it can be confirmed that the first slot 15 according to a sixth embodiment includes both the first slot 15 according to a third embodiment and the first slot 15 according to a fourth embodiment, this may also be regarded as a shape symmetric up, down, left and right.

As described above, the first slot 15 and the fourth slot 45 having the same shape may be implemented in various shapes under the assumption that the slots are symmetric up, down, left and right, and the beam pattern characteristics of the array antenna 100 according to a second embodiment of the present invention may be improved through the first slot 15 and the fourth slot 45, and the MIMO antenna 200 including the array antenna may be miniaturized and slimmed overall.

Meanwhile, the array antennas 100 according to the first and second embodiments of the present invention may be regarded as implementing linear polarization in a vertical and horizontal or +45° and −45° orthogonal structure.

Figure 8:
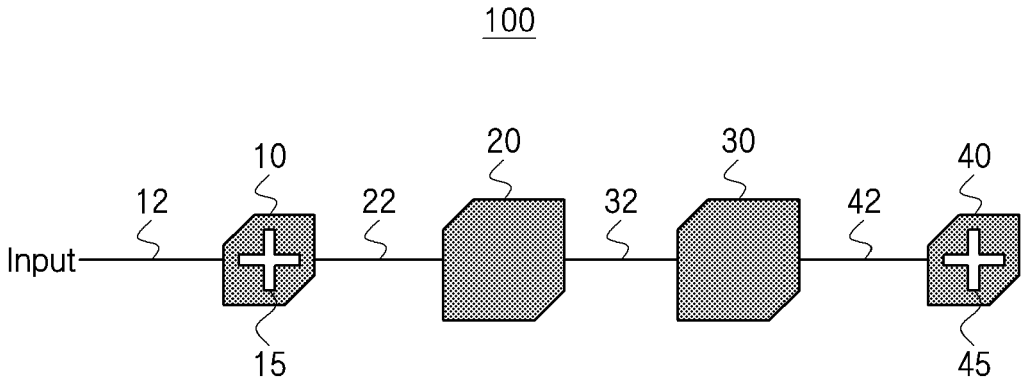
FIG. 8 is a plan view showing an array antenna according to a third embodiment of the present invention.

FIG. 8 is a plan view showing an array antenna 100 according to a third embodiment of the present invention.

All the matters described about the array antennas 100 according to a first embodiment and a second embodiment are equally applied to the array antenna 100 according to a third embodiment, and it will be described below focusing on the difference.

The first radiator 10, the second radiator 20, the third radiator 30, and the fourth radiator 40 included in the array antenna 100 according to a third embodiment have an M-polygonal shape (M is a positive integer) symmetric in the diagonal direction, and referring to FIG. 8, it can be confirmed that the first radiator 10, the second radiator 20, the third radiator 30, and the fourth radiator 40 have a hexagonal shape symmetric in the diagonal direction.

Here, the first radiator 10, the second radiator 20, the third radiator 30, and the fourth radiator 40 may be regarded as having a shape in which corner portions facing each other are partially removed in the diagonal direction in the radiator of a regular N-polygonal shape (N is a multiple of 4) of the array antenna 100 according to a first embodiment, and as the shapes of the first radiator 10, the second radiator 20, the third radiator 30, and the fourth radiator 40 are formed like this, there is an advantage in that circular polarization can be implemented, and more specifically, in an orthogonal structure of a right-hand circularly polarized wave (RHCP) and a left-hand circularly polarized wave (LHCP).

Figure 9:
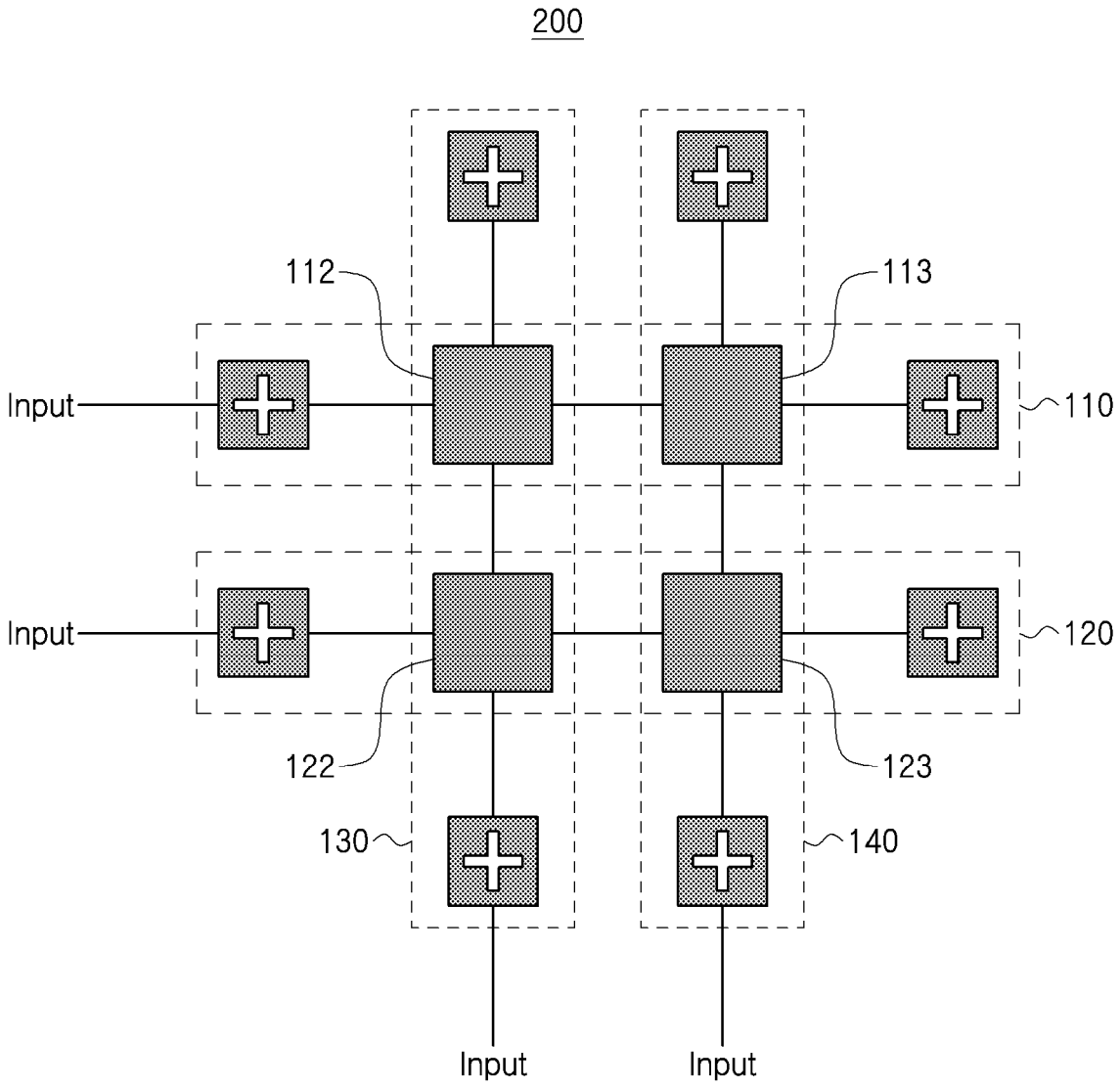
FIG. 9 is a view showing a 4×4 MIMO antenna implemented using the array antenna according to a second embodiment of the present invention as an example.

FIG. 9 is a view showing a 4×4 MIMO antenna implemented using an array antenna 100 according to a second embodiment of the present invention as an example.

For the convenience of explanation, array antennas in the horizontal direction are referred to as a first array antenna 110 and a second array antenna 120 from the top, and array antennas in the vertical direction are referred to as a third array antenna 130 and a fourth array antenna 140 from the left.

Since it is a 2×2 MIMO antenna 200, there are four input terminals, and one input terminal is connected to each array antenna.

Describing on the basis of the first array antenna 110, the second radiator 112 may be shared as the third radiator of the third array antenna 130, and the third radiator 113 may be shared as the third radiator of the fourth array antenna 140.

Describing on the basis of the second array antenna 120, the second radiator 122 may be shared as the second radiator of the third array antenna 130, and the third radiator 123 may be shared as the second radiator of the fourth array antenna 140.

That is, the second radiator 20 and the third radiator 30 of the array antenna 100 according to the first to third embodiments of the present invention may be shared with other array antennas, and therefore, as each array antenna does not need to be arranged separately, the MIMO antenna 200 including the array antennas may be miniaturized and slimmed overall.

Figure 10:
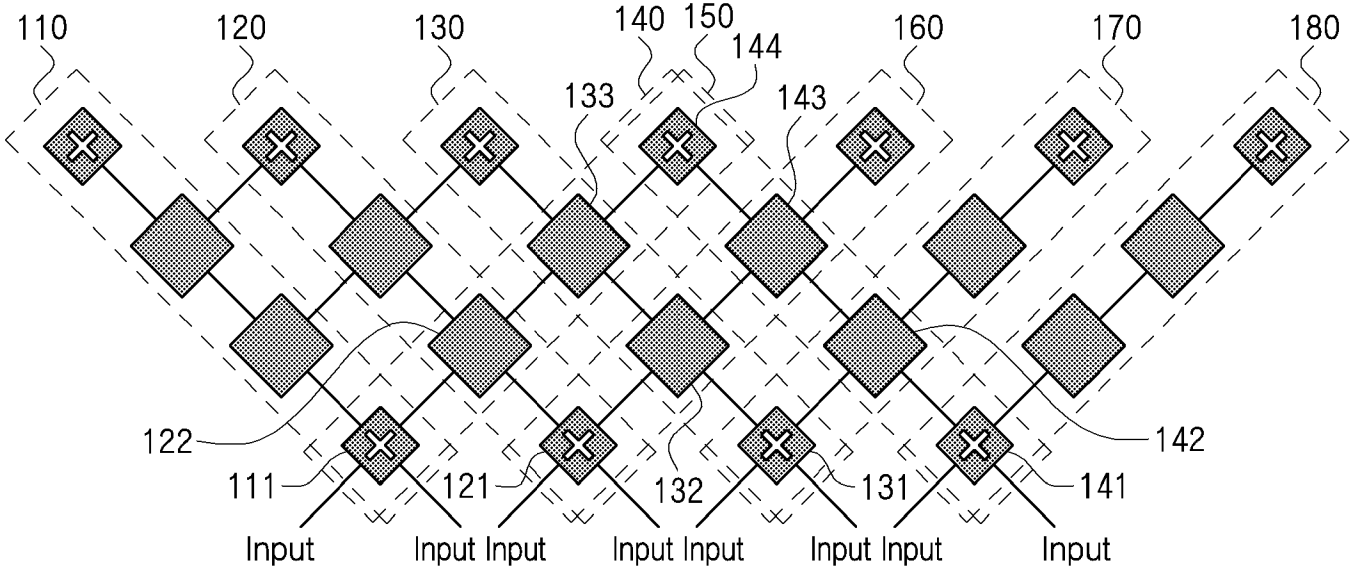
FIGS. 10 and 11 are views showing MIMO antennas implemented using the array antenna according to a second embodiment of the present invention as an example.

FIG. 10 is a view showing another MIMO antenna 200 implemented using an array antenna 100 according to a second embodiment of the present invention as an example.

For the convenience of explanation, the array antennas in the \ direction are referred to as a first array antenna 110, a second array antenna 120, a third array antenna 130, and a fourth array antenna 140 from the left, and the array antennas in the / direction are referred to as a fifth array antenna 150, a sixth array antenna 160, a seventh array antenna 170, and an eighth array antenna 180 from the left.

The first array antenna 110 may share the first radiator 111 as the first radiator of the fifth array antenna 150, and the second array antenna 120 may share the first radiator 121 as the first radiator of the sixth array antenna 160, and the second radiator 122 as the second radiator of the fifth array antenna 150. The third array antenna 130 may share the first radiator 131 as the first radiator of the seventh array antenna 170, the second radiator 132 as the second radiator of the sixth array antenna 160, the third radiator 133 as the third radiator of the fifth array antenna 150. The fourth array antenna 140 may share the first radiator 141 as the first radiator of the eighth array antenna 180, the second radiator 142 as the second radiator of the seventh array antenna 170, the third radiator 143 as the third radiator of the sixth array antenna 160, and the fourth radiator 144 as the fourth radiator of the fifth array antenna 150.

Figure 11:
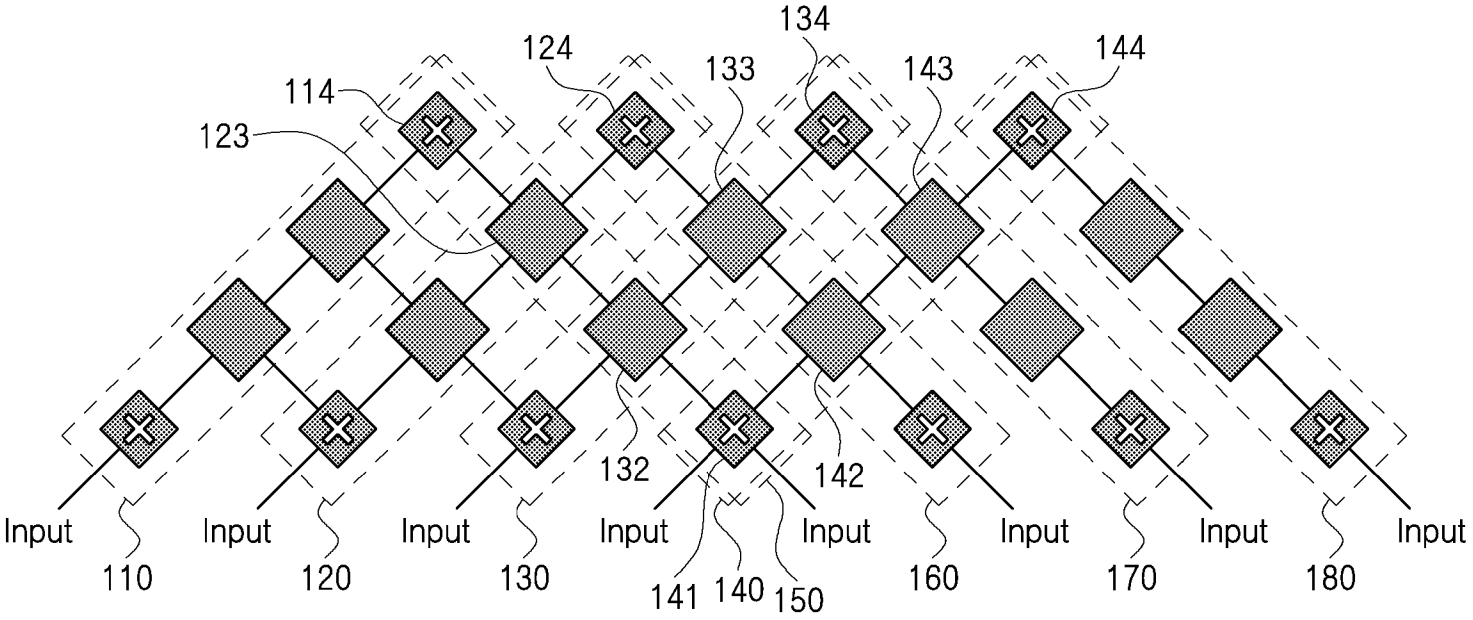

FIG. 11 is a view showing another MIMO antenna 200 implemented using the array antenna 100 according to a second embodiment of the present invention as an example, in which the MIMO antenna 200 shown in FIG. 10 is rotated by 180° clockwise or counterclockwise, and the position of the input terminal is arranged in an opposite direction.

For the convenience of explanation, the array antennas in the / direction are referred to as a first array antenna 110, a second array antenna 120, a third array antenna 130, and a fourth array antenna 140 from the left, and the array antennas in the \ direction are referred to as a fifth array antenna 150, a sixth array antenna 160, a seventh array antenna 170, and an eighth array antenna 180 from the left.

The first array antenna 110 may share the fourth radiator 114 as the fourth radiator of the fifth array antenna 150, and the second array antenna 120 may share the third radiator 123 as the third radiator of the fifth array antenna 150, and the fourth radiator 124 as the fourth radiator of the sixth array antenna 160. The third array antenna 130 may share the second radiator 132 as the second radiator of the fifth array antenna 150, the third radiator 133 as the third radiator of the sixth array antenna 160, the fourth radiator 134 as the fourth radiator of the seventh array antenna 170. The fourth array antenna 140 may share the first radiator 141 as the first radiator of the fifth array antenna 150, the second radiator 142 as the second radiator of the sixth array antenna 160, the third radiator 143 as the third radiator of the seventh array antenna 170, and the fourth radiator 144 as the fourth radiator of the eighth array antenna 180.

Meanwhile, although FIGS. 9 to 11 are shown to include the array antenna 100 according to a second embodiment of the present invention, it is not necessarily limited thereto, and the array antenna 100 according to a first or third embodiment of the present invention may also be implemented as shown in FIGS. 9 to 11.

Until now, array antennas 100 according to the first to third embodiments of the present invention and MIMO antennas 200 including the array antennas have been described. According to the present invention, as a plurality of radiators having different sizes and symmetric shapes with respect to the center of the array antenna 100 is included, and a slot for improving the characteristics of the beam pattern is formed in some of the plurality of radiators, the MIMO antenna 200 may be miniaturized and slimmed overall. In addition, since the array antenna 100 is arranged to include a plurality of radiators having different sizes and symmetric shapes on the basis of the center of the antenna, and a MIMO antenna 200 can be implemented by intersecting the array antenna with other array antennas in the vertical direction, there is an effect of reducing the interference phenomenon as the array antenna operates in an orthogonal mode. Furthermore, since it is possible to concentrate radiation power in the main radiation direction and distribute radiation power directed in other directions as the input signals inputted into a plurality of radiators are supplied to have varied magnitude and the same phase, there is an effect of improving the side lobe characteristics.

Figure 12:
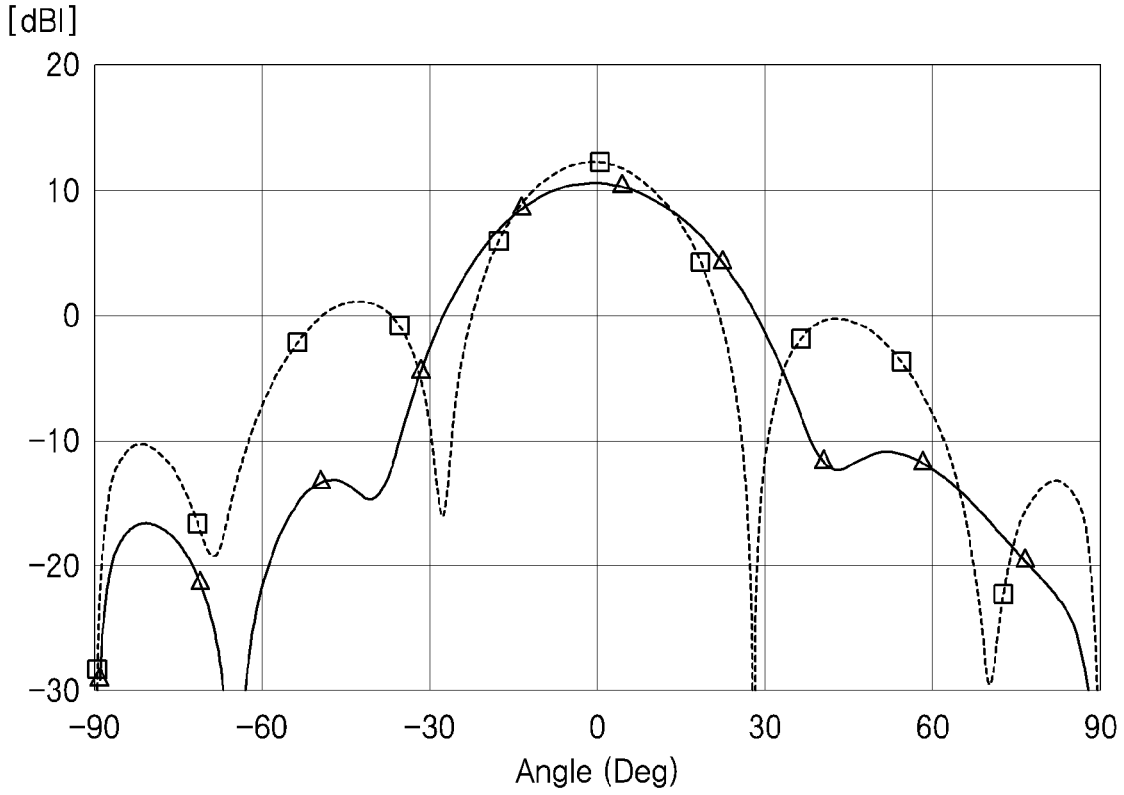
FIG. 12 is a diagram illustrating gains according to the radiation pattern angles of a conventional array antenna and the array antenna according to a second embodiment of the present invention.

The effect related to improvement of the side lobe characteristics can be confirmed through FIG. 12 which shows the gain according to the angle of the radiation pattern. The graph marked with □ is a graph of a conventional array antenna, more specifically, a graph of an array antenna including four radiators of the same square shape, and the graph marked with Δ is a graph of the array antenna 100 according to a second embodiment of the present invention.

Referring to FIG. 12, it can be confirmed that the graph decreases toward the left and right from the point where the angle of the radiation pattern is 0, and therefore, the absolute value of the gain of the graph marked with Δ is displayed to be larger than that of the graph marked with □ at the same angle of the radiation pattern. Since it can be regarded that the gain of the array antenna 100 according to a second embodiment of the present invention is higher than that of the conventional array antenna at a radiation pattern angle of the same gain, the interference phenomenon is reduced as isolation is secured, and as a result, it can be regarded that the side lobe characteristics are improved. This may also be understood by comparing the side lobe levels of the two graphs (11.2 dB in the conventional array antenna, and 21.5 dB in the array antenna according to a second embodiment of the present invention).

Figure 13:
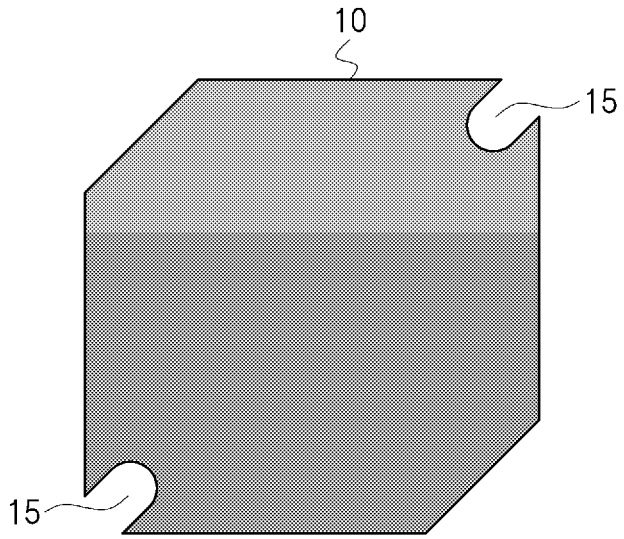
FIG. 13 is a view showing a seventh embodiment of a first slot included in a first radiator.

FIG. 13 is a view showing a seventh embodiment of the first slot 15 included in the first radiator 10. The fourth slot 45 has the same shape as that of the first slot 15.

Referring to FIG. 13, the first radiator 10 has a shape partially removing a pair of corners facing each other with interposition of a first diagonal line therebetween to be parallel to a first diagonal direction in a regular N-polygonal shape (N being a multiple of 4) symmetric in the first diagonal direction, and also has a shape partially digging a pair of corners facing each other with interposition of a second diagonal line perpendicular to the first diagonal line therebetween in the same shape toward a center of the first radiator.

Figure 14:
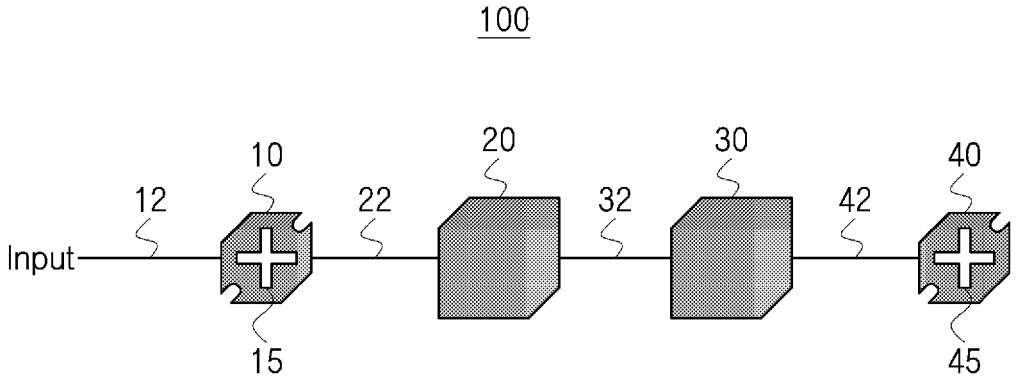
FIG. 14 is a plan view showing an array antenna according to a seventh embodiment of the present invention.

FIG. 14 is a plan view showing an array antenna 100 according to a seventh embodiment of the present invention.

Referring to FIG. 14, the first radiator 10, the second radiator 20, the third radiator 30, and the fourth radiator 40 included in the array antenna 100 according to a seventh embodiment have an M-polygonal shape (M being a positive integer) symmetric in the diagonal direction. In FIG. 14, the first radiator 10, the second radiator 20, the third radiator 30, and the fourth radiator 40 have a hexagonal shape symmetric in the diagonal direction.

In FIG. 14, the first radiator 10 has a shape partially removing a pair of corners facing each other with interposition of a first diagonal line therebetween to be parallel to a first diagonal direction in a regular N-polygonal shape (N being a multiple of 4) symmetric in the first diagonal direction, and also has a shape partially digging a pair of corners facing each other with interposition of a second diagonal line perpendicular to the first diagonal line therebetween in the same shape toward a center of the first radiator, and the second radiator 20 has a shape partially removing a pair of corners facing each other with interposition of the first diagonal line therebetween to be parallel to the first diagonal direction in a regular N-polygonal shape (N being a multiple of 4) symmetric in the first diagonal direction.

Although the embodiments of the present specification have been described with reference to the accompanying drawings, those skilled in the art may understand that the present invention may implemented in other specific forms without changing the technical spirit or essential features. Therefore, it should be understood that the embodiments described above are illustrative and not restrictive in all respects.

The invention claimed is:

1. An array antenna comprising:

a first radiator, one end of which is connected to a first feeding line;

a second radiator, one end of which is connected through a second feeding line connected to another end of the first radiator;

a third radiator, one end of which is connected through a third feeding line connected to another end of the second radiator; and a fourth radiator, one end of which is connected through a fourth feeding line connected to another end of the third radiator, wherein the first and second radiators and the third and fourth radiators are symmetric with respect to the third feeding line, the first radiator and the second radiator have a shape partially removing a pair of corners facing each other with interposition of a first diagonal line therebetween to be parallel to a first diagonal direction in a regular N-polygonal shape symmetric in the first diagonal direction, N being a multiple of 4, and the first radiator has a shape partially digging a pair of corners facing each other with interposition of a second diagonal line perpendicular to the first diagonal line therebetween in the same shape toward a center of the first radiator.

2. The array antenna according to claim 1, wherein the first feeding line, the second feeding line, the third feeding line, and the fourth feeding line are arranged in a same direction, and a width of the second radiator is larger than a width of the first radiator on the basis of the third feeding line, and a width of the third radiator is larger than a width of the fourth radiator on the basis of the third feeding line.

3. The array antenna according to claim 2, wherein the widths are measured on the basis of a direction perpendicular to the arrangement direction of the first feeding line, the second feeding line, the third feeding line, and the fourth feeding line.

4. The array antenna according to claim 1, wherein the first radiator further includes a first slot symmetric up, down, left and right, and the fourth radiator further includes a fourth slot of a shape the same as that of the first slot.

5. The array antenna according to claim 1, wherein the second radiator is shareable with a second array antenna different from the array antenna, and the third radiator is shareable with a third array antenna different from the array antenna.

* * * * *